United States Patent [19]

Vogt

[11] 4,253,301

[45] Mar. 3, 1981

[54] FUEL INJECTION STAGED SECTORAL COMBUSTOR FOR BURNING LOW-BTU FUEL GAS

[75] Inventor: Robert L. Vogt, Schenectady, N.Y.

[73] Assignee: General Electric Company, Schenectady, N.Y.

[21] Appl. No.: 951,181

[22] Filed: Oct. 13, 1978

[51] Int. Cl.[3] ..... F02C 3/20

[52] U.S. Cl. ..... 60/39.46 P; 60/746; 60/39.82 P

[58] Field of Search ..... 60/39.46 P, 733, 742, 60/746, 747, 760, 39.82 P

[56] References Cited

U.S. PATENT DOCUMENTS

| | | | |
|---|---|---|---|
| 2,884,758 | 5/1959 | Oberle | 60/39.46 P |
| 3,630,024 | 12/1971 | Hopkins | 60/742 |
| 3,713,588 | 1/1973 | Sharpe | 60/742 |
| 3,777,983 | 12/1973 | Hibbins | 60/742 |
| 3,792,582 | 2/1974 | Markowski | 60/747 |
| 3,934,409 | 1/1976 | Quillevere et al. | 60/746 |
| 4,045,956 | 9/1977 | Markowski et al. | 60/746 |
| 4,112,676 | 9/1978 | DeCorso | 60/746 |
| 4,168,609 | 9/1979 | Greenberg et al. | 60/39.82 P |
| 4,192,139 | 5/1980 | Buchheim | 60/39.82 P |

FOREIGN PATENT DOCUMENTS

| | | |
|---|---|---|
| 894054 | 4/1962 | United Kingdom . |
| 1489339 | 10/1977 | United Kingdom . |
| 1507530 | 4/1978 | United Kingdom . |
| 1516868 | 7/1978 | United Kingdom . |

*Primary Examiner*—Louis J. Casaregola
*Attorney, Agent, or Firm*—Jerome C. Squillaro

[57] ABSTRACT

A high-temperature combustor for burning low-BTU coal gas in a gas turbine is described. The combustor comprises a plurality of individual combustor chambers. Each combustor chamber has a main burning zone and a pilot burning zone. A pipe for the low-BTU coal gas is connected to the upstream end of the pilot burning zone; this pipe surrounds a liquid fuel source and is in turn surrounded by an air supply pipe; swirling means are provided between the liquid fuel source and the coal gas pipe and between the gas pipe and the air pipe. Additional preheated air is provided by counter-current coolant air in passages formed by a double wall arrangement of the walls of the main burning zone communicating with passages of a double wall arrangement of the pilot burning zone; this preheated air is turned at the upstream end of the pilot burning zone through swirlers to mix with the original gas and air input (and the liquid fuel input when used) to provide more efficient combustion. One or more fuel injection stages (second stages) are provided for direct input of coal gas into the main burning zone. The countercurrent air coolant passages are connected to swirlers surrounding the input from each second stage to provide additional oxidant.

11 Claims, 12 Drawing Figures

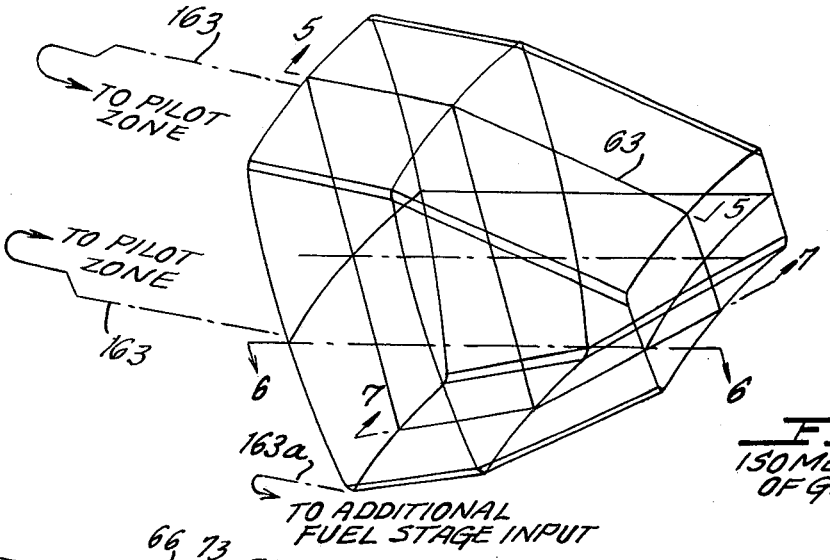
FIG. 4
ISOMETRIC VIEW OF GAS PATH
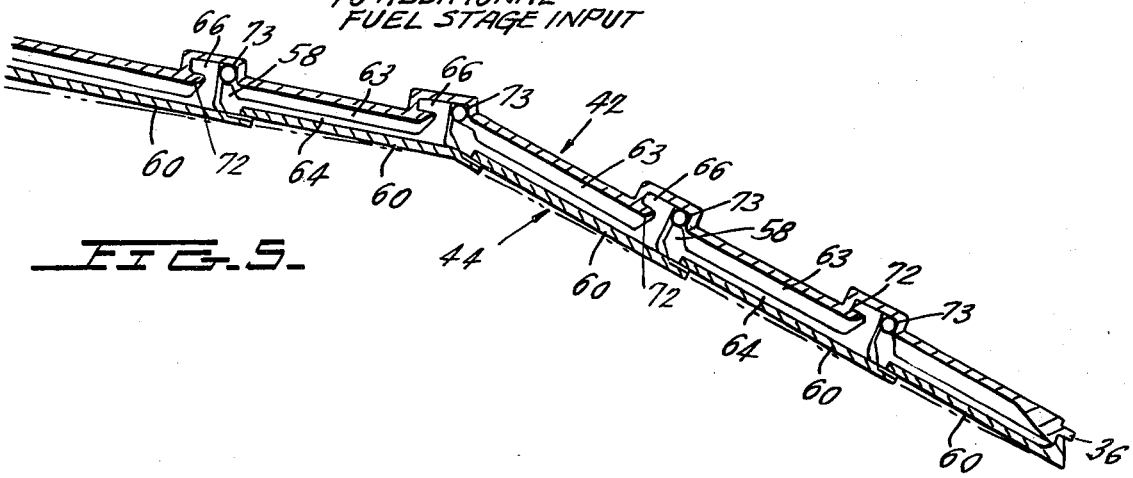
FIG. 5
FIG. 6
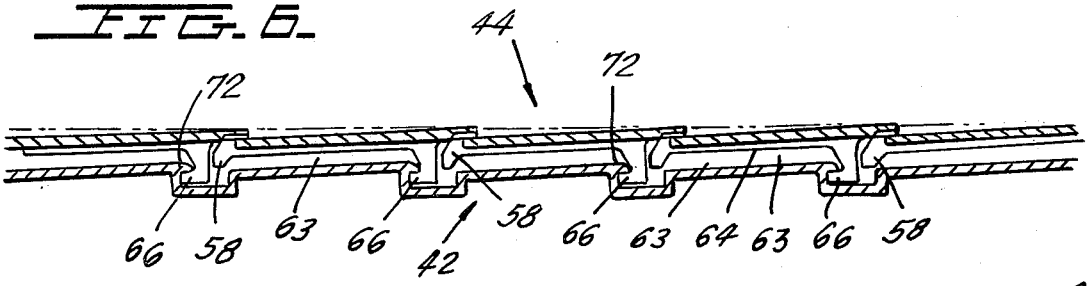
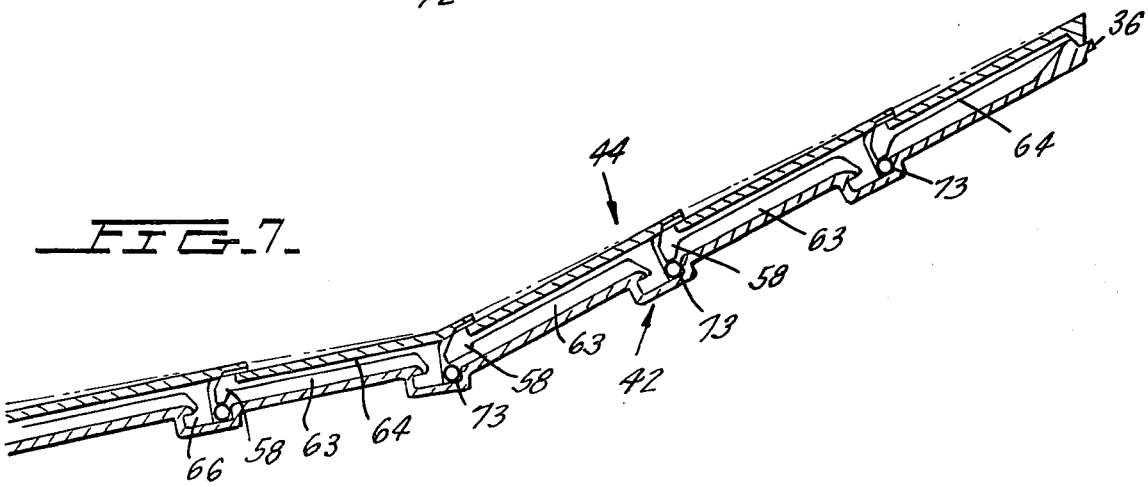
FIG. 7

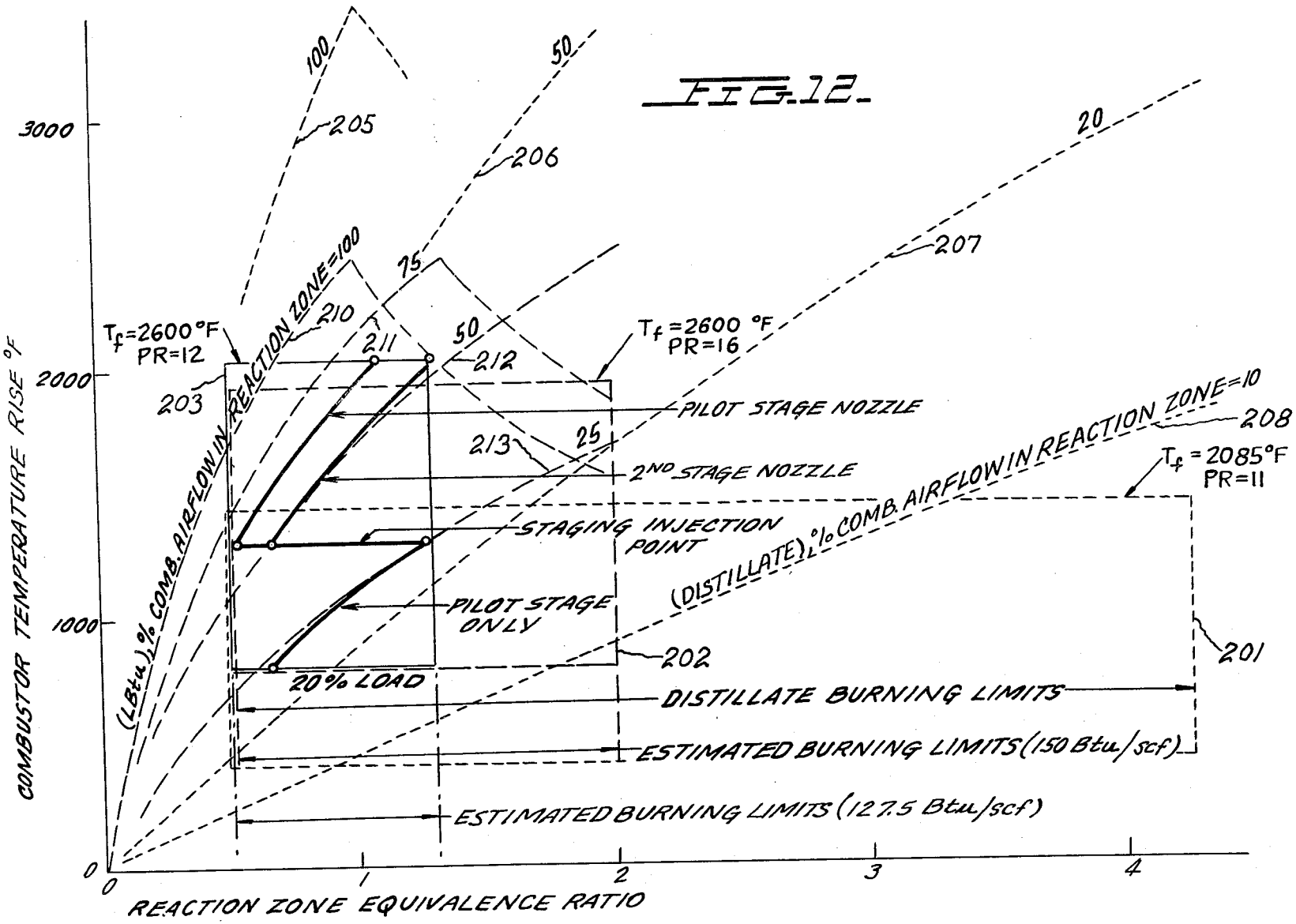
FIG. 12
COMBUSTOR TEMPERATURE RISE °F
REACTION ZONE EQUIVALENCE RATIO
3000
2000
1000
0
1
2
3
4
$T_f$=2600°F PR=12
$T_f$=2600°F PR=16
$T_f$=2085°F PR=11
203
205
206
207
208
201
202
210
211
212
213
20
50
100
25
75
(LBS/LB) % COMB. AIRFLOW IN REACTION ZONE=100
% COMB. AIRFLOW IN REACTION ZONE=10
PILOT STAGE NOZZLE
2ND STAGE NOZZLE
STAGING INJECTION POINT
(DISTILLATE)
PILOT STAGE ONLY
20% LOAD
DISTILLATE BURNING LIMITS
ESTIMATED BURNING LIMITS (150 Btu/scf)
ESTIMATED BURNING LIMITS (127.5 Btu/scf)

FUEL INJECTION STAGED SECTORAL COMBUSTOR FOR BURNING LOW-BTU FUEL GAS

BACKGROUND OF THE INVENTION

The invention disclosed herein was made in the course of, or under, a contract with the U.S. Department of Energy.

This invention relates to combustors for burning low-BTU fuel gas such as coal gas in a high-temperature gas turbine and more particularly to fuel injection staged combustors which may have one or more fuel injection staging points.

Uncertainties in the cost and availability of petroleum and natural gas, coupled with the abundant supply of coal in countries such as the United States, have resulted in interest in the use of coal-derived, low-heating-value gaseous fuels in gas turbines. One particular application of low-BTU coal gas, i.e., coal gas with heating values of approximately 2500 BTU/lbm as compared with about 22,500 BTU/lbm for natural gas, is in a system wherein a coal gasification plant is integrated with a combined gas turbine/steam turbine cycle apparatus generating base load electrical power.

The present invention is an improvement of that disclosed in application Ser. No. 882,072 for Sectoral Combustion For Burning Low-BTU Fuel Gas filed Mar. 1, 1978 by R. L. Vogt and assigned to the assignee of the present invention.

A combustor for a gas turbine of the system described above, or for any gas turbine powered by low-BTU fuel gas, must meet several requirements. In order to achieve high cycle efficiencies, the low-BTU coal gas combustor must be operable at high firing temperatures, and in particular, at temperatures closer to the maximum flame temperatures attainable for its fuel than combustors fired by high-BTU fuels. The coal gas combustor must also accommodate fuel/air ratios several times those of combustors using conventional fuel gas such as natural gas and should include means to ensure thorough mixing of gas and air since, for a given desired combustor exit temperature, less dilution air can be used to control combustor exit temperature profiles than is available in combustors fired by high-BTU fuels. In addition, the coal gas combustor, as with other gas turbine combustors, should have minimum heat losses and cooling requirements, good flammability and stability characteristics, low emissions, and be easily fabricable and maintainable.

It is an object of the present invention not only to provide a combustor which is operable to burn low-BTU fuel gas as its primary fuel but also to provide a fuel injection staging feature in combination with and as part of the combustor.

It is a further object of the present invention to provide an efficient low BTU coal gas combustor for a gas turbine which includes the fuel injection staging feature above set forth and also includes a pilot burning zone in which either fuel oil or low BTU coal gas or both may be initially burned and ignited and passed on to the main burning zone of the combustor in order to provide sufficient combustion products which may be delivered to a turbine nozzle at a temperature of 2600° F. or greater.

It is further object of the present invention to provide additional input to the combustor of low BTU coal gas which may by-pass the pilot burning zone and be ignited in the principal burning zone to provide additional combustion products for delivery at appropriate temperatures to the gas turbine.

It is a further object of the present invention to provide a combustor including a pilot burning zone and a main burning zone in which only the main burning zone is fully air cooled, thereby requiring no parasitic externally supplied coolant making it compact and easily maintainable, but also the air cooling extends into the pilot burning zone for the same purposes.

SUMMARY OF THE INVENTION

A principal combustion chamber is provided for high temperature burning of low BTU coal gas for delivery to a gas turbine in connection with a dual fuel operation in which both fuel oil and low BTU coal gas may be used alternately or together. The same device may be built to use a single fuel type or multiple fuels. The fuel injection staging feature is in combination with the combustion chamber as described in the aforementioned co-pending application. The combustion chamber as described in said prior application may be one of several such chambers circumferentially positioned about the gas turbine axis. The combustion chamber of the present invention is divided into two principal sections, a main burning zone and a pilot burning zone. The pilot burning zone has a fuel injection staging feature in combination therewith. Such fuel staging provides an otherwise limited combustor with the features of reducing combustion product carbon monoxide below that of a non-staged device at both ends of the burning range. More stages allow a greater reduction. Low carbon monoxide results in high efficiency and low pollution. In addition, fuel staging provides a wide combustion operating turndown ratio; that is, a wider variation in overall lean to rich fuel and air mixture strengths which is wider than the non-staged fuel flow would allow without blow out.

In gas turbines operated in conjunction with coal gasifiers, fuel injection staging allows transfer at lower loads than non-staged combustors. Also the fuel injection staging allows the combustor to operate on widely varying fuel properties and heating values. Fuel injection staging also provides the capability of injection of liquid fuel or gas fuel or either such fuel or both fuels simultaneously.

In addition to fuel injection staging, the present invention has a recessed pilot zone which provides a longer ignition burning length, ignition in a sheltered flow region and equivalence ratio control, not only in the gaseous fuel, but also on the higher energy fuel which may be a liquid fuel. The pilot zone is lean throughout the high energy fuel burning range for control of nitrogen oxides. In addition, the pilot burning zone allows the high energy fuel to be used as a pilot fuel over the enire burning range without compromising the paneled liners which are hereinafter described.

The second stage burner comprises a plurality of nozles shown hereinafter as two nozzles, but which may be of any desired number, —as many as required for the multiple stage steps. The main burning zone and the pilot burning zone are each of double wall construction; the main burning zone has an annularly sectoral cross-section shape while the pilot burning zone is circular in cross-section. An outer shell wall of the chamber of the main burning zone carries essentially all pressure loading during operation and also supports an inner liner wall which in turn carries essentially all of the thermal loads. This inner liner wall extends not only through the main burning zone as in the aforesaid application, but also back through the pilot burning zone.

A coolant channel is defined between the outer and liner walls of the main burning zone and the pilot burning zone. The coolant channel is continuous from the main burning zone through the pilot burning zone. The flow of air in the channels, thus provided between the inner and outer walls of the main burning zone and the pilot burning zone, is in counter-current relationship to the combustion flow for convection cooling of the walls. The panels which form the liner wall of the main burning zone are grooved as described in the aforesaid application. The additional liner wall of the pilot burning zone is circular but stepped to define the counter-current coolant passage.

The panels in the main burning zone are provided with additional slots or ports to admit a portion of the counter-current flow to the combustion zone for film cooling of the liner wall inner surface. Means are also provided to introduce the remaining portion of the coolant air into the combustion zone near the entrance to the pilot burning zone at the upstream end of the pilot burning zone as preheated combustion air. Therefore both the main burning zone liner and the pilot zone liner have counter-current regenerative flow of the oxidant providing the dual function of liner cooling and reaction zone oxidant. Both the pilot and the combustion chamber liner flows are fluidly connected to a set of mixing swirl vanes at the fuel entrance chamber where the oxidant enters from the channels in which it has been preheated.

Also included as part of the structure of the present invention are the means for providing the liquid or other high energy fuel, the low BTU coal gas and the additional second stage burner structures. The fuel injection staging is accomplished by multiple nozzles. The multiple nozzle configuration provides quieter burning, higher volume mixing rate, shorter burning lengths and therefore less surface area to cool; also higher acoustic frequencies that preclude resonance between mechanical frequencies and chemical heat release pressure fluctuations.

BRIEF DESCRIPTION OF THE DRAWINGS

While this specification concludes with claims particularly pointing out and distinctly claiming the subject matter regarded as the invention, the invention will be better understood from the following description taken in connection with the accompanying drawings in which:

FIG. 4 is an isometric schematic view of the counter-current gas path based primarily on the various views of FIGS. 5, 6 and 7 and related to FIG. 2.

FIG. 5 is an enlarged cross-sectional view of the upper portion of the combustion chamber of FIG. 2 as shown in FIG. 2.

FIG. 6 is an enlarged cross-sectional view through the wall of the combustion chamber taken at 90° from the view of FIG. 5.

FIG. 7 is an enlarged cross-sectional view corresponding to the lower portion of the combustion chamber shown in FIG. 2.

FIG. 12 is a diagrammatic showing of the thermal operations and forces present in the structure of the present invention.

DETAILED DESCRIPTION OF THE DRAWINGS

It should here be noted that the arrangement of the combustion chambers around the gas turbine is circumferential as described in the aforesaid copending application for patent. The present description is therefore directed to a single one of the combustors having the main burning zone, the pilot burning zone and fuel injection and staging structures.

The primary combustor (FIGS. 1 and 2) constituting the main burning zone section 32 is provided with a flange 36 at its downstream end by which it is connected to the intake of the gas turbine structure, indicated schematically at the turbine which in turn is intake nozzle 34. It will again be understood that a number of combustors are arranged circumferential of the turbine in the manner already described in the above-mentioned application. The description of the single composite combustor consisting of the main burning zone, the pilot burning zone and the fuel injection and additional staging applies to a single one of a plurality of such combustors which may be arranged circumferentially of the gas turbine.

Figure 1:
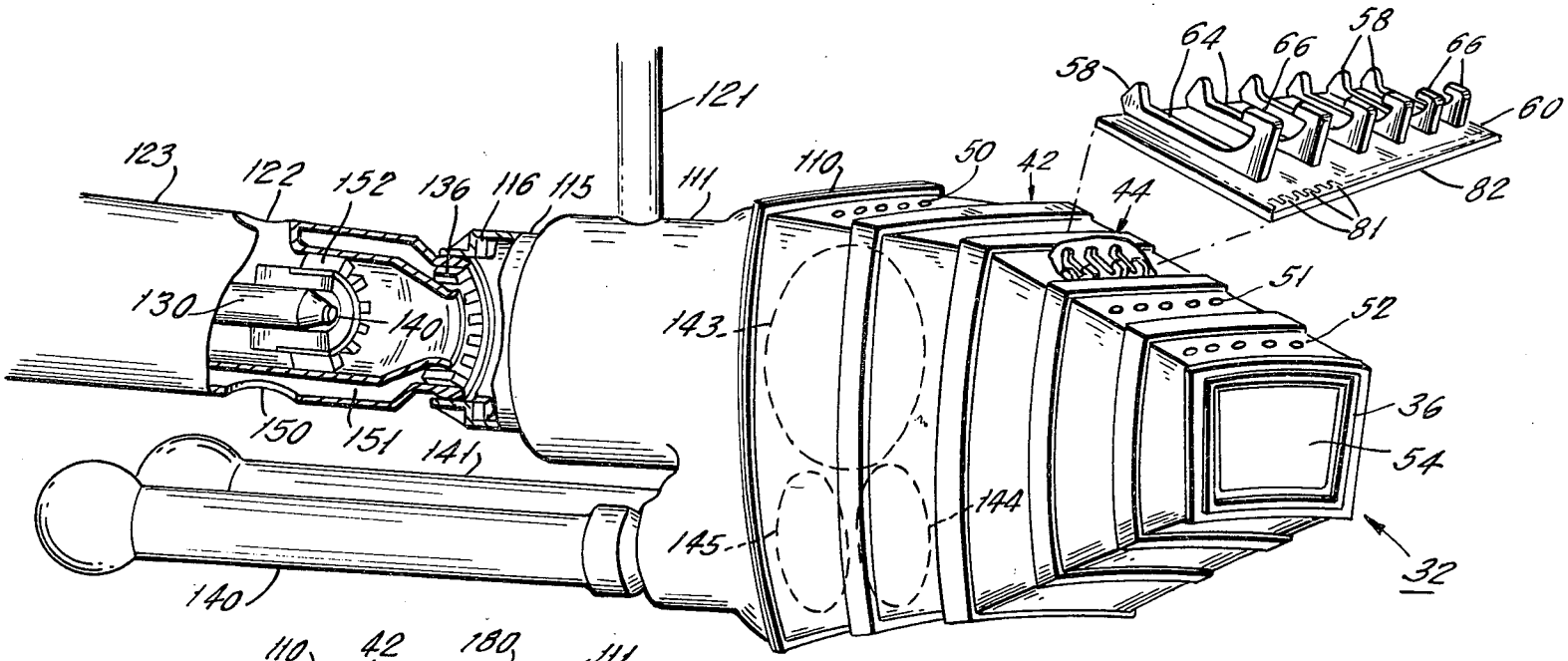
FIG. 1 is a view in perspective partly broken away and partly exploded showing a preferred embodiment of the invention.

The main burning zone 32 of the combustor includes an outer shell wall 42 of corrugated construction which serves to carry nearly all the pressure loading during operation and an inner wall 44 which serves to support virtually all of the thermal gradients associated with combustion. This double wall concept effectively separates stresses due to thermal gradients from stresses due to pressure loading, thus avoiding fatigue problems which are normally a limiting factor in high temperature applications. Also shown, particularly in FIG. 1 are the rows of primary and secondary dilution air holes 50 and 51 respectively, and the cooling air holes 52, all located in shell wall 42. The annular sectoral shape of the chamber which forms the main burning zone 32 tapers from approximately a square near the upstream end 46 of the combustion chamber 32 to an annular sector approximately l/n of the total annulus of the first stage turbine nozzle 34 at the chamber downstream end 54 where n is the total number of combustion chambers. This conformation as described in the prior application, eliminates the need for transition sections between the combustor and turbine which are required with conventional circular or can-type combustion chambers. This in turn permits a shorter gas turbine and it also simplifies cooling requirements since the peculiar shape of transition sections and changing from a circular or multi-circular cross-section to an annular cross-section coupled with a desired combustor peak operating temperature of about 3000° F. would necessitate water cooling of the transition section which would add complexity and degrade cycle performance.

Figure 2:
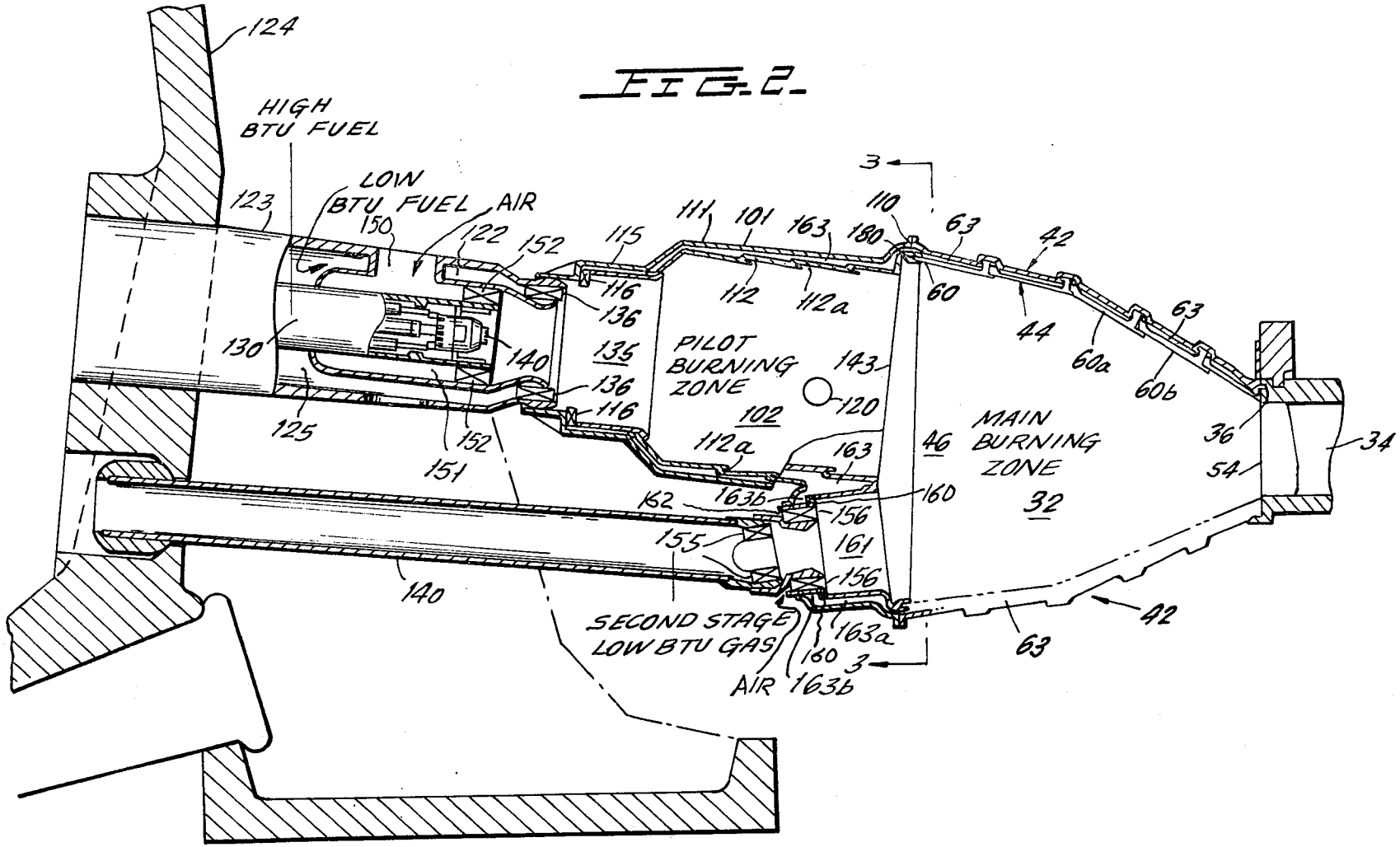
FIG. 2 is a longitudinal section through the structure of FIG. 1 showing the structure and operation of the main burning zone of the combustion chamber, the pilot zone and the counter-current coolant channels as well as the fuel injection stages.
Figure 8:
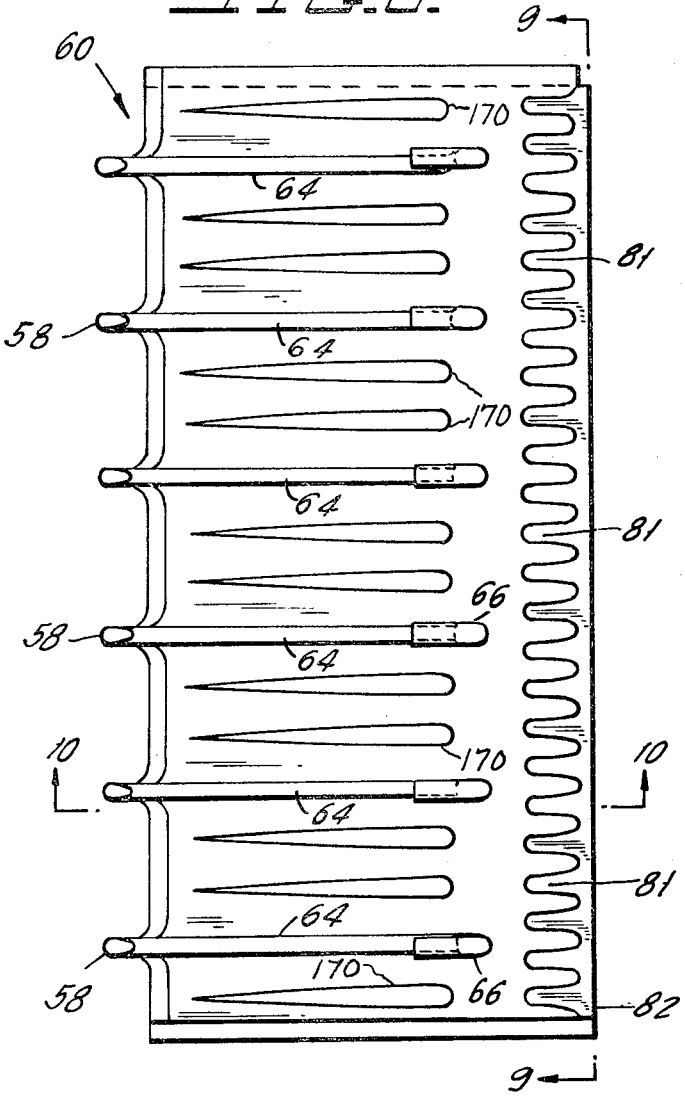
FIG. 8 is a plan view of the plates which form the liner for the main burning zone or combustion chamber.
Figure 9:
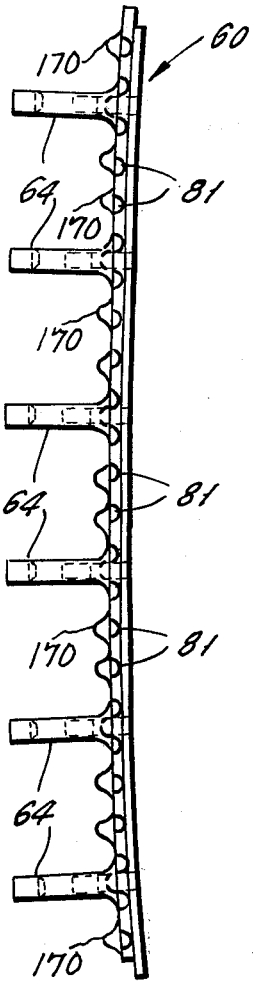
FIG. 9 is an end view of the plates of FIG. 8.
Figure 10:
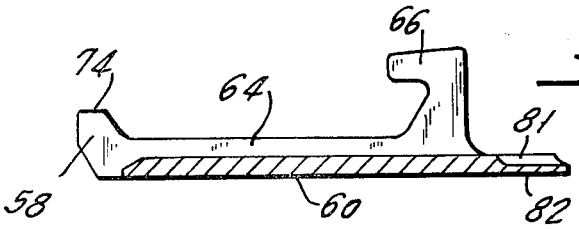
FIG. 10 is a cross-sectional view taken on line 10—10 of FIG. 8.

The double wall construction and fuel and air flow arrangements for combustion chamber 32 are apparent in FIG. 2 as well as in the enlarged views of FIGS. 5, 6 and 7.

The corrugated outer wall 42, preferably fabricated from a commercially available high strength nickel base alloy such as inconel 718, provides the mechanical support for liner walls 44 and also supports essentially all of the pressure loading during operation of the combustor. The corrugated construction of shell wall 42 provides high stiffness (estimated as forty times the stiffness of a typical plate of a comparable thickness) for controlling bending and vibratory stresses and also forms a groove and lip arrangement within shell wall 42 which as shown in greater detail in FIGS. 8 through 11 engages panel supports such as support 58 of the retainer for the liner wall 44. By means of cooling arrangements, described hereinafter, shell wall 42 is operable at temperatures 500° to 600° F. lower than liner wall 44 when low BTU fuel is burned and with negligible thermal gradients between its inner and outer surfaces.

Within shell wall 42 and separated and supported therefrom by panel supports 58 is liner wall 44 which is comprised of a plurality of overlapping liner panels 60 as shown in the exploded portion of FIG. 1 and in FIGS. 8 to 11. As shown in FIGS. 2, 6 to 8 and 11, liner wall 44, when viewed in cross-section, has a segmented appearance due to the interlocking of the edges of abutting liner panels such as panels 60*a* and 60*b*. The upstream and downstream ends of adjacent panels overlap in a telescoping manner.

During operation of the gas turbine, liner wall 44 supports virtually all the thermal gradients which are imposed on the main burning zone 32 of the combustor within the inner wall 44 as well as cooling of combustor components. Hence the panels of liner wall 44 are preferably fabricated from a high temperature nickel base alloy such as Udimet 500 or a cobalt-base alloy such as MAR-M509 both readily available commercially.

The unique arrangement for supporting liner wall 44 and shell wall 42 is illustrated in FIGS. 8 through 11 (particularly FIG. 11) as well as in the FIGS. 5, 6 and 7 which are included for the additional purpose of illustrating the gas flow path. Each liner panel 60 has rigidly attached thereto a plurality of panel supports such as the support 58 which are equally spaced and aligned approximately parallel to the direction of counter-coolant flow in the coolant channel 63 defined between outer shell wall 42 and liner wall 44. Panel support 58 extends from an elongated rib section 64 with a hook 66 at its downstream end and a retainer 58 at its upstream end. Hook 66 is adapted to fit within groove 70 formed in the corrugated shell wall 42 and to engage lip 72 of the sheel wall 42. Hook 66 is held within groove 70 by contact with the retainer 73, a segmented ring of circular cross-section which is inserted into groove 70 after the fitting of hook 66 therein. Retainer 73 is in turn supported within groove 70 by retainer support 74 of the adjacent downstream panel support. The rib section 64, in addition to providing support 58 and hook 66, adds stiffness and coolable surface area to liner panel 60 thus reducing peak panel temperatures, temperature gradients and stresses as well as guiding coolant flow within channel 63.

Both convective and film cooling systems are used to control temperatures of the combustor components in the main burning zone and the cooling arrangements are of considerable importance with regard to achieving high combustor and cycle efficiencies and firing temperatures relatively close to the adiabatic stoichiometric temperature limit of the low-BTU coal gas employed as the primary combustor fuel. The outer shell wall 42 and liner 44 define therebetween the coolant channel 63 to which cooling air from a compressor (not shown) is admitted through cooling air holes 52 in the outer shell wall near the downstream end of combustion chamber 32. During operation of the gas turbine, cooling channels 63 accomodate the flow of air along the entire liner wall 44 in counter-current or reverse flow relationship to the direction of flow in the main burning zone 32; the counter-current flow convectively cools the outer surface of liner wall 44 as well as the inner surface of shell wall 42. The effectiveness of the heat transfer is enhanced by the direction of cooling flow since for each liner panel the coolest air contacts the outer portion at the downstream end of the panel.

Figure 11:
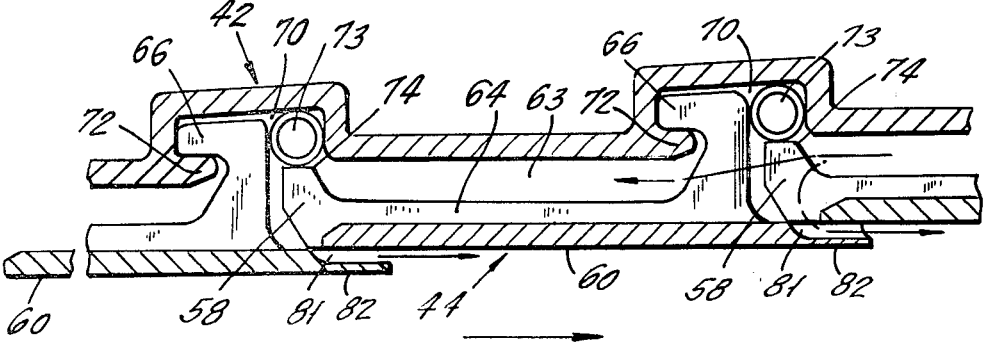
FIG. 11 is an enlarged view showing the manner in which the plates are connected to each other.

Each liner panel such as panel 60 of FIG. 11 includes film cooling grooves 81 and the overhanging lip 82 near its downstream so that as the counter-current air flows along the outer surface of inner wall 44, a portion of it turns 180° and passes through the grooves 81 near the region of overlap of the adjacent downstream panel and then flows along the inner hot surface of the downstream panel for film cooling thereof. The function of the additional vents 50 and 51 are described in the aforesaid earlier application.

The cooling channel 63 thus formed by the adjacent panels is continued into the cooling channel 101 of the pilot burning zone 102 as hereinafter described.

Figure 3:
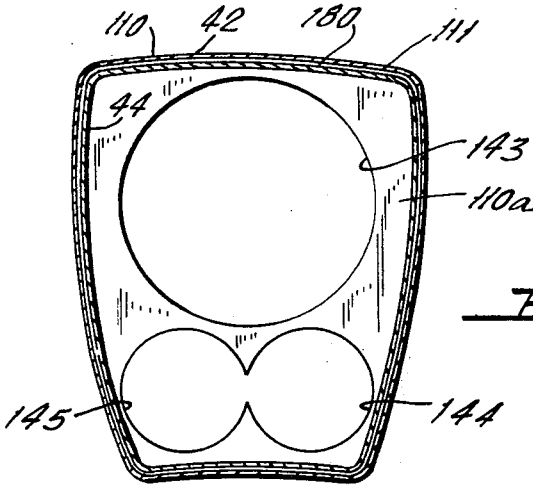
FIG. 3 is a cross-sectional view taken from line 3–3 of FIG. 2 looking in the direction of the arrows.

In addition to the main burning zone 32 the present invention includes the pilot burning zone 102 in which ignition first takes place. The outer wall 42 of the combustion chamber is connected at the matching annular flanges 110 to the housing for the outer wall 111 of the outer pilot burning zone. The flanges 110 extend, as seen in FIG. 3, to the rear wall 110*a* of the main burning zone structures 32 to provide entries as hereinafter described for the different fuel sources. The outer wall 110 of the pilot burning zone, is of sufficient structural strength and may be of the same material as the outer wall 42 of the combustion chamber 32 to support the mechanical stresses imposed thereon. The inner wall 112 of the pilot burning zone provides an annulus 163 which constitutes a continuation of the plurality of passages 63 so that the coolant air as it flows counter to the direction of the heated gases serves to cool the inner wall 112 of the pilot burning zone.

The passage 163 is continued to the opening 115 at the upstream end of the pilot burning zone 102 where it passes just the swirling vanes 116 to provide preheated air for the initial combustion.

An opening 120 (FIG. 2) in the pilot burning zone may be connected to the tube 121 (FIG. 1) in order to provide for access to the pilot burning zone for any ignition device which may be desired or required in order to ignite the low thermal energy BTU coal gas. Two means of providing for fuel access are provided in the structure of the present invention. The low BTU coal gas may be led by appropriate ducts to the entry opening 122 of the tapering cylindrical tube 123 which in combination with the structural support 124 supports the upstream end of the combustion unit. The low BTU gas entering through the entry port 122 passes through the manifold 125 which surrounds the high energy fuel entry pipe 130. The manifold 125 communicates with the entry section 135 of the pilot burning zone 102 through the swirling vanes 136 which are spaced around the exit from the manifold. The swirling coal gas exiting from the manifold 125 through the swirling vanes 136 mixes with the preheated air which has flowed up through the channels 63 into the passage 163 and past the swirling vanes 116 to provide a highly combustible mixture which may be ignited by any appropriate means in the pilot burning zone. Air from entry 150 into manifold 151 passes through vanes 152. The additional air supply provided through the opening 150 into the manifold 151 to provide swirling air past vanes 152 aids in combustion; this swirling air is in addition to the atomizing air which is used together with the liquid fuel in the pipes 130 leading to the nozzle 140 which is of well known construction, and in addition to the swirling preheated air.

In addition, the high energy fuel may be injected through the pipe 130 which, in a well known manner, produces a mixture of atomizing air and liquid fuel flowing from the nozzle 140 into the upstream end 135 of the pilot burning zone 102. The combination of fuel injection from the nozzle 140 with appropriate atomizing air to mix with the low BTU gas introduced through the opening 122 in the manifold 125 and in turn to mix further with the preheated air introduced from the openings 115 and the swirling vanes 116 produces a mixture which may be self igniting under appropriate circumstances. But initial ignition may be through tube 121 and opening 120.

After the initial high energy fuel has been introduced from the pipe 130 through the atomizing opening 140 into the pilot burning zone 102 together with the low energy BTU coal gas introduced passed the swirling vanes 136, the high energy liquid fuel may, in fact, be cut off and combustion may then continue. The operator has the choice of using low energy fuel, or high energy fuel or the combination of both as particular circumstances may require.

It will be noted that the inner wall 112 of the pilot burning zone which, together with the outer wall 111 forms the regenerative cooling air passage, is continued around the entire pilot burning zone being approximately supported and spaced from the outer wall 111 in any suitable manner which will not interfere with the flow of air. This makes it possible to provide additional sources or stages of low energy fuel. In FIGS. 1, 2 and 3, two such sources or stages of low energy fuel have been illustrated in the form of the pipes 141 and 142. The pilot burning zone as seen particularly in FIGS. 1, 2 and 3 communicates with the main burning zone 32 through the large opening 143 or wall 110*a*. The additional low energy fuel passages 141, 142 also communicate with the combustion chamber 32 through the passages 144 and 145. While two such intakes for the additional stages of fuel have been shown, it is possible to use a single such intake or to use three or more as the situation and the heating demand may require.

Additional low energy fuel, as previously pointed out, may be injected through, for instance, pipe 141 to enter the main burning zone 32 and be ignited by the combustion process which is proceeding in the main burning zone 32. The second stage low BTU gas entry passes from the pipe 141 through a set of swirling vanes 155 which causes the low BTU swirling second stage gases to mix with the regenerative air entering past the swirling vanes 156.

As previously pointed out, not only does the counter-current air passage 63 and 163 extend from the combustion chamber into the annular passage 163 surrounding the pilot zone but also the passage 163 as its lower and downstream end communicates preheated combustion air through the swirling vanes 160 with the entry section 161 of the second stage low BTU gas input to the combustion chamber 32. In addition, the counter-current cooling air channel 63 at the lower end of the combustion chamber 32 communicates with the additional passage 163*a* which in turn through opening 163*b* passes preheated combustion air through the swirling vanes 160 and mixes with the incoming fuel in the pipe 141 in the mixer section 161 just as that fuel enters the main burning zone or combustion chamber 32, thus preheating the fuel and air mixture and enhancing its ignition. The diagrammatic air flow passage arrangement of FIG. 4 illustrates more clearly the air flow.

Air from entry 162 passes through swirling vanes 156 into the entry section or mixing barrel 161 of the second stage low BTU gas input in order to provide that amount of air to mix with the fuel so that the resulting mixture, with the preheated air from 160 will be sufficiently rich to burn at the lowest desired value of fuel flow, yet not so rich at the highest desired value of fuel flow that the combustion process is extinguished.

Having thus described the structural characteristics of the staged combustor of the present invention, a better understanding of the operation thereof may be obtained by reference to FIG. 12 which is a plot of the temperature rise across the combustor versus the equivalence ratio in the reaction zone. Three boxes, 201, 202, and 203, are shown on the field of the plot. The largest, box 201, is dotted and its width approximately represents the burning limits of number two distillate. The height of the dotted box 201 is the range of required combustor temperature rise, the bottom being the minimum of ignition and full speed, no load, the top being full speed, full load for current technology.

The smallest box, 203, is drawn with solid lines and represents the approximate burning limits for 127.5 Btu/scf fuel. The box height is for the combustor temperature rise range from 20% of load, the approximate transfer point to begin burning coal gas, up to a firing temperature of 2600° F. for a compressor pressure ratio of twelve. The third box, 202, is dashed and is similar to box 203 except the fuel lower heating value is 150 Btu/scf and the pressure ratio is sixteen.

Curved lines 205–208, which represent constant air flow through this reaction zone as a percent of the total combustor airflow, are superimposed on the boxes. The curved lines, 205–208, show that no more than about 18% of the airflow can enter the reaction on distillate or the mixture will be too lean at full speed, no load (lower left corner of dotted box). Also, no less than about 9% of the air can enter the reaction zone or the mixture will be too rich to burn at full speed, full load (upper right corner of dotted box).

When burning the 127.5 Btu/scf fuel and using dashed curves 210–213, the lower, left corner of the box 203 requires no more than 28% air, and the upper right corner requires no less than 55%. This is impossible without fuel injection staging. The Z-shaped lines in the 127.5 Btu/scf burning range box 203 represent the percent of combustor air mixing with the fuel in the fuel injection staged combustor. Beginning from the lower left of box 203, fuel is supplied to only the pilot stage and mixes with about 25% of the air. When this line reaches the rich burning limit about half way through the load range, i.e., at half the required combustor temperature rise, the fuel flow is split between the pilot burner and the second stage or auxiliary burners. This is shown pictorially by the double solid line beginning approximately from the lean burning limit and ending at the rich burning limit and at a 2600° F. firing temperature. By way of example, a single stage fuel injection system operating at the base load operating point is very rich, and carbon monoxide emissions will be high, e.g. 3,000–4,000 ppm. However, by utilizing fuel staging in accordance with the present invention, and leaning the fuel-air mixture by only ten percent, will reduce carbon monoxide emissions by about a factor of ten, an acceptable level for most applications.

The present invention is distinguishable from prior art techniques which vary fuel mass flow and/or the air mass flow only by controlling and maintaining the reaction zone equivalence ratio within a selected range which ensures an efficient combustion reaction throughout the burning range from leanest to richest overall equivalence ratios. Accordingly, the combustor of the present invention does not vary fuel or air mass flow but rather controls the fuel air ratio in the reaction zone by staging of the multiple fuel nozzles. In this way, the combustion reaction is capable of operating within about 250° of the adiabatic, stoichiometric, homogeneous equilibrium temperature limit.

By utilizing the two zone burning, i.e., a pilot zone and a main burning zone, the low temperature rise in the pilot burning zone enables $NO_x$ and CO to be controlled by fuel injection control and air preheat. The main burning zone increases the reaction zone temperature rise and additional increment above the pilot zone by the staging action to control local equivalence ratio and achieve an efficient chemical reaction throughout the burning range of equivalence ratios. Additionally, fuel injection staging in the manner described herein permits a wider combustion temperature rise turndown and wider blow out limits since a wider range of overall equivalence ratios at which stable and efficient burning is achieved.

While the invention has been described with respect to a specific embodiment thereof, it is to be understood that various additional features or elements may be incorporated:

The plate 60 of FIGS. 8 to 11, if necessary, may be strengthened by additional ribs 170 which may also act not only as reinforcing ribs but also as additional heat transfer surfaces.

In contrast with the prior structure described in the aforesaid application, the passage 63 continues into the passage 163 for the pilot burning zone as well as the passage 163*a* for the second fuel stage. The passage 163 provides for counter-current cooling air for the pilot burning zone 102 and also provides the entry at opening 115 and swirling vanes 116 for mixture of the preheated air with the principal input of low BTU gases as well as any fuel injection device which have been utilized in connection therewith.

The additional passage 163*a* at the bottom combines with the continuation 163*b* of passage 163 also to provide swirling air past the vanes 156 for the low BTU coal gas entering from the supply source 140 into the section 161 where the gas and preheated air and additional air are combined prior to entry into the main combustion chamber 32.

The utilization of multiple nozzles in the fuel injection staging provides quieter burning, higher volume mixing rate, shorter burning lengths, hence less surface area to cool, and higher acoustic frequencies that preclude resonance between mechanical frequencies and chemical heat release pressure fluctuation. While the main burning zone which constitutes the combustion chamber 32 is reduced in length owing to the fact that the pilot burning zone 102 serves to initiate combustion, the overall length of the entire device is not appreciably increased.

In summary, in addition to the low BTU coal gas fired combustor described in the aforesaid prior application, the present combustor includes:

a pilot burning zone for initial ignition of combustion products the double wall air path is extended to the wall of the pilot burning zone to provide preheated air for the pilot burning zone the low BTU gas and additional air input are inserted at the upstream end of the pilot burning zone swirling vanes are provided at each gas inlet to the pilot burning zone—from the double wall passage, from the low BTU gas and from the additional air supply high energy fuel may also selectively be injected into the upstream end of the pilot burning zone one or more additional fuel stages for low BTU gas may be provided with direct entry past swirling vanes into the main burning zone.

While there has been shown and described what is considered a preferred embodiment of the invention, it is understood that various other modifications may be made therein, and it is intended to claim all such modifications which fall within the true spirit and scope of the present invention.

What is claimed is:

1. A fuel injection staged combustion chamber having a main burning zone and a pilot burning zone;

said combustion chamber being operable to burn low BTU fuel gas for a gas turbine;

first fuel supply means for introducing a low thermal energy BTU fuel gas at one end, the upstream end, of said pilot burning zone;

the other end of said pilot burning zone, the downstream end, being connected to and communicating through an opening in a transverse wall at one end of said main burning zone, the upstream end thereof; the other end of said main burning zone, the downstream end, having a passage for directing the combustion products from said combustion chamber to said gas turbine;

an outer shell wall structure for said combustion chamber;

said outer shell wall comprising a first outer shell wall section for said main burning zone and a second outer shell wall section for said pilot burning zone;

a first liner wall housed coaxially within said first shell wall section and having an outer surface and an inner surface, said first shell wall section and said liner wall each having a cross-section of a shape substantially equal to an annular sector of said gas turbine;

said liner wall defining internally thereof the main burning zone and further defining between said first liner wall and said first shell wall section a first coolant channel adapted to accommodate during operation of said combustion chamber a flow of air in countercurrent relationship to flow in said main burning zone for cooling said liner wall outer surface;

air supply means for introducing air into said combustion chamber;

second fuel supply means for introducing liquid fuel selectively into the upstream end of said pilot burning zone and said combustion chamber;

a second liner wall housed coaxially within said second outer shell for said pilot burning zone;

said second liner wall defining between said second liner wall and said second outer shell a second coolant channel adapted, during operation of said combustion chamber, to accommodate a flow of air in countercurrent relationship to flow in said pilot burning zone for cooling the outer surface of said second liner wall;

the downstream end of said second coolant channel being connected to the upstream end of said first coolant channel; and second stage fuel injection means for low BTU fuel gas, said second stage fuel injection means being connected to an additional opening in said transverse wall for direct entry into said main burning zone.

2. The combustion chamber of claim 1 wherein a plurality of additional openings are provided in said transverse wall; and a plurality of stages of fuel injection means for low BTU fuel gas being individually connected to each of said plurality of openings for direct entry into said main burning zone.

3. The combustion chamber of claim 1 wherein said second fuel supply means comprises;

a fuel pipe connected to the upstream end of said pilot burning zone;

a liquid fuel nozzle housed within and spaced from said pipe and defining a passage for low BTU coal gas therebetween; and a coal gas swirler disposed between said liquid fuel nozzle and said fuel pipe.

4. The combustion chamber of claim 3 wherein a portion of said air supply means comprises;

a duct connecting the upstream end of said second coolant channel and the upstream end of the interior of said pilot burning zone;

the wall of said duct being substantially concentric with said fuel pipe exteriorly thereof and turning said coolant air from said second coolant passage into said pilot burning zone; and swirling means disposed between said fuel pipe and said duct wall.

5. The combustion chamber of claim 1 wherein swirling means are provided adjacent said additional opening surrounding said second stage fuel injection means; and a first passage from said second coolant channel to said swirling means to said additional opening and a second passage from said first coolant channel to said swirling means at said additional opening;

said passages directing a portion of the coolant from each channel into the interior of the upstream end of said main burning zone adjacent the entry point from said second stage fuel injection means to swirl said coolant air with the input from second stage.

6. The combustion chamber of claim 5 wherein an additional upstream air supply is provided comprising an air pipe concentric with said fuel pipe and exteriorly thereof and swirling means are provided between the exterior of said fuel pipe and the interior of said air pipe.

7. A fuel injection staged combustor for burning low BTU fuel gas in a gas turbine, said combustor comprising:

a combustion chamber having a main burning zone and a pilot burning zone, each zone having an upstream end and a downstream end, the downstream end of said pilot zone being connected through an opening in a transverse wall at the upstream end of said main zone;

a first fuel supply means for introducing a low BTU fuel gas into the upstream end of said pilot zone;

a second fuel supply means for introducing a liquid fuel selectively into the upstream end of said pilot burning zone;

air supply means for introducing air into said combustion chamber; and staged fuel injection means for introducing additional low BTU fuel gas into said main burning zone through an opening in said transverse wall.

8. The combustor of claim 7 wherein said transverse wall includes a plurality of openings with a plurality of staged fuel injection means for low BTU fuel gas connected to each of said plurality of openings for direct entry into said main burning zone.

9. The combustor of claim 7 further comprising:

an outer shell wall structure for said combustion chamber, said outer shell wall including a first outer shell wall section for said main burning zone and a second outer shell wall section for said pilot burning zone; and a first liner wall housed coaxially within said first shell wall section and having an outer surface and an inner surface, said first shell wall section and said liner wall each having a cross-section of a shape substantially equal to an annular sector of said gas turbine.

10. The combustor of claim 9 wherein said first liner wall defines internally thereof said main burning zone and further defines between said first liner wall and said first shell wall section a first coolant channel adapted to accommodate during operation of said combustion chamber a flow of air in countercurrent relationship to flow in said main burning zone for cooling said liner wall outer surface.

11. The combustor of claim 7 wherein said second fuel supply means comprises:

a fuel pipe connected to the upstream end of said pilot burning zone;

a liquid fuel nozzle housed within and spaced from said pipe and defining a passage for low BTU coal gas therebetween; and a coal gas swirler disposed between said liquid fuel nozzle and said fuel pipe.

* * * * *